US010731414B2

(12) United States Patent
Junghans et al.

(10) Patent No.: US 10,731,414 B2
(45) Date of Patent: Aug. 4, 2020

(54) SELF-RESCUE SYSTEM FOR LARGE MACHINES

(71) Applicant: KOMATSU MINING GERMANY GMBH, Düsseldorf (DE)

(72) Inventors: Jens Junghans, Ratingen (DE); Rüdiger Just, Hilden (DE)

(73) Assignee: KOMATSU MINING GERMANY GMBH, Düsseldorf (DE)

( * ) Notice: Subject to any disclaimer, the term of this patent is extended or adjusted under 35 U.S.C. 154(b) by 249 days.

(21) Appl. No.: 15/124,227

(22) PCT Filed: Feb. 12, 2015

(86) PCT No.: PCT/DE2015/000082

§ 371 (c)(1),
(2) Date: Sep. 7, 2016

(87) PCT Pub. No.: WO2015/131866

PCT Pub. Date: Sep. 11, 2015

(65) Prior Publication Data

US 2017/0022759 A1 Jan. 26, 2017

(30) Foreign Application Priority Data

Mar. 7, 2014 (DE) ..... 10 2014 003 469

(51) Int. Cl.
*E06C 5/04* (2006.01)
*E06C 9/08* (2006.01)
(Continued)

(52) U.S. Cl.
CPC ..... *E06C 5/06* (2013.01); *E06C 5/04* (2013.01); *F15B 1/021* (2013.01); *F15B 1/04* (2013.01); *F15B 15/202* (2013.01)

(58) Field of Classification Search
CPC ..... E06C 5/06; E06C 9/00; E06C 9/06; E06C 9/08; E06C 9/9085; E06C 9/10;
(Continued)

(56) References Cited

U.S. PATENT DOCUMENTS 826,884 A * 7/1906 Reynalds ..... E06C 9/06 182/163
2,531,263 A * 11/1950 Fink ..... B64C 1/24 105/447

(Continued)

FOREIGN PATENT DOCUMENTS

| | | |
|---|---|---|
| AU | 2008 202 858 A1 | 1/2009 |
| CN | 201 236 620 Y | 5/2009 |
| CN | 203 822 141 U | 9/2014 |

OTHER PUBLICATIONS

International Search Report issued by the European Patent Office in International Application PCT/DE2015/000082.

*Primary Examiner* — Daniel P Cahn
(74) *Attorney, Agent, or Firm* — Henry M. Feiereisen LLC

(57) ABSTRACT

An emergency descent system includes at least one ladder which is articulated on at least one supporting unit on a bearing device. The ladder is designed to be unfolded about this bearing device out of a rest position in which the ladder is disposed parallel to the at least one supporting unit and into a working position, wherein a push-out unit and a pivot unit operatively connected thereto by means of a catch are associated with the ladder. The pivot unit drives the push-out unit by the kinetic energy generated during the unfolding, wherein the push-out unit moves away from the at least one supporting unit at a first acute angle, and in the operating position, the push-out unit forms an acute angle with the at least one supporting unit and the pivot unit is held at an
(Continued)

obtuse angle relative to the push-out unit on a stop associated with the at least one supporting unit.

17 Claims, 10 Drawing Sheets

(51) Int. Cl.
*E06C 5/06* (2006.01)
*F15B 1/02* (2006.01)
*F15B 1/04* (2006.01)
*F15B 15/20* (2006.01)

(58) Field of Classification Search
CPC ..... E06C 5/08; E06C 5/10; E06C 5/12; E06C 5/14; E06C 5/22; F15B 1/021; F15B 1/04; F15B 15/202; A62B 99/00; B60R 3/02
See application file for complete search history.

(56) References Cited

U.S. PATENT DOCUMENTS 2,933,149 A * 4/1960 Lee ..... B64C 1/24 14/71.5
2,981,363 A * 4/1961 Sidabras ..... B65D 88/34 182/129
3,556,248 A * 1/1971 Brown ..... B62B 3/00 182/15
3,601,220 A * 8/1971 Saucier ..... B60R 3/02 182/84
4,014,486 A * 3/1977 Nelson ..... B64C 1/24 105/447
4,068,770 A * 1/1978 Boehringer ..... B60R 3/02 14/71.1
4,815,561 A * 3/1989 Ostrander ..... E06C 9/10 182/163
4,892,170 A * 1/1990 O'Donnell ..... E06C 1/34 182/100
5,154,125 A * 10/1992 Renner ..... B60R 3/02 105/349
5,655,448 A * 8/1997 Junghans ..... B41F 13/0024 101/216
6,378,654 B1 * 4/2002 Ziaylek, Jr. ..... B60R 3/005 182/127
6,981,572 B2 * 1/2006 Hedley ..... B63B 27/14 182/127
7,621,374 B2 * 11/2009 Richey ..... E04F 11/064 182/77
7,870,932 B2 * 1/2011 Lapke ..... B60R 3/02 182/127
8,113,314 B2 * 2/2012 Kennedy ..... E06C 5/04 182/62.5
8,397,869 B2 * 3/2013 Tsutsumi ..... E02F 9/0833 182/127
9,500,028 B2 * 11/2016 Cale ..... E06C 1/39
2002/0189899 A1 * 12/2002 Hedley ..... B60R 3/02 182/84
2003/0173153 A1 * 9/2003 Hedley ..... B63B 27/14 182/97
2004/0159492 A1 * 8/2004 Hedley ..... B60R 3/02 182/86
2004/0178018 A1 * 9/2004 Christenson ..... B60R 3/02 182/97
2005/0211502 A1 * 9/2005 LaBrash ..... B60R 3/02 182/127
2007/0256894 A1 * 11/2007 Horn ..... E06C 9/08 182/127
2009/0038885 A1 * 2/2009 Ellement ..... B60R 3/02 182/97
2009/0145692 A1 * 6/2009 Flickinger ..... A01D 41/1261 182/127
2012/0181109 A1 * 7/2012 Rund ..... B60R 3/02 182/97
2013/0008743 A1 * 1/2013 Hedley ..... E06C 1/393 182/95
2013/0118832 A1 * 5/2013 Hedley ..... E06C 5/02 182/106
2016/0221510 A1 * 8/2016 Petersen ..... B60R 3/02

* cited by examiner

SELF-RESCUE SYSTEM FOR LARGE MACHINES

CROSS-REFERENCES TO RELATED APPLICATIONS

This application is the U.S. National Stage of International Application No. PCT/DE2015/000082, filed Feb. 12, 2015, which designated the United States and has been, published as International Publication No. WO 2015/131866 and which claims the priority of German Patent Application, Serial No. 10 2014 003 469.0, filed Mar. 7, 2014, pursuant to 35 U.S.C. 119(*a*)-(*d*).

BACKGROUND OF THE INVENTION

The present invention relates to a self-rescue system including at least one descent means constructed as a ladder which is pivotally connected to at least one support unit that is assigned to a large machine on a bearing devices provided therefore and the descent means is configured to be foldable about these bearing devices from a resting position into an operating position.

Self-rescue systems are required in many large machines to enable operating personnel for example to evacuate from the large machine via a conventional descent or ascent if needed via a particular route. Such self-rescue systems are intended to ensure a fastest possible evacuation in the event of an accident. Such systems not only have to meet high demands with regard to their operational reliability but also an increased functionality and health relevant comfort requirements.

From the state of the art rescue systems are known which are intended to enable a vertical descent of operating personnel by means of a throw ladder. Also known are sliding ladders or folding systems, which are intended to enable a descent when needed.

Even though these self-rescue systems have proven useful, they have the disadvantage that self-rescue from great heights poses considerable risks for a user, especially when the user is injured, because these self-rescue systems provide poor comfort and do not meet the safety requirements of the users.

SUMMARY OF THE INVENTION

It is therefore an object of the present invention to provide a self-rescue system for a large machine, which overcomes the above-mentioned disadvantages. In particular a controlled deployment of the self-rescue system from a resting position into an operation position is to be ensured.

This object is solved by the features in the independent claim, in particular in that the descent means includes a push-out unit and a pivot unit operatively connected with the push-out unit via a catch on a lever plate and the pivot unit drives the push-out unit by the kinetic energy generated by the pivoting, wherein the push-out unit moves away from the support unit in a first acute angle and the pivot unit is held at a second obtuse angle relative to the push-out unit on a stop assigned to the support unit.

In an advantageous embodiment of the self-rescue system according to the invention it is provided that the outward movement of the push-out unit and the pivoting movement of the pivot unit is decelerated by a speed throttling. An additional speed throttling may be required when the large machine for example is not even but is tilted relative to the ground. This may result in greater initial speeds during release as a result of changed tilting moments during folding out of the pivot unit, which are not sufficiently counteracted by the counter weight of the push-out unit and may lead to injury to persons situated underneath the self-rescue system In a further particularly advantageous embodiment of the self-rescue system according to the invention the support unit, the push-out unit and the pivot unit and also the speed throttling are connected to form an assembly unit. This makes it possible to pre-assemble the self-rescue system in a manner that is adapted to the large machine. The system can thus be dismounted from the large machine if needed and mounted on another large machine of the same type.

According to another advantageous embodiment of the present self-rescue system the support unit has an upper free end and a lower free end when installed. The push-out unit is hereby pivotally connected on the upper free end via a first bearing device and at the lower free end to a lever plate which receives a second bearing device, and is connected with the support unit via the second bearing device assigned to the lever plate so that the push-out unit can be moved away from the support unit by the value of the distance between the first bearing device and the second bearing device.

In a further particularly advantageous embodiment, the push-out unit is connected with the support unit via a tension spring. As a result during the outward movement, the push-out unit is always pushed against the catch on the lever plate of the pivot unit.

In a further embodiment of the self-rescue system according to the invention, the speed throttling for decelerating the pivot movement of the pivot unit is configured as a hydraulic cylinder braking system with a compensation unit configured as a pressure accumulator.

In a further embodiment, a compression spring is provided for pushing the pivot unit away from the support unit. The compression spring is connected with the support unit in the region of the upper free end and is supported on the pivot unit. In the resting position, the compression spring is preloaded and in the operating position of the pivot unit substantially relaxed.

In a further particularly preferred embodiment, a helical spring arranged in the pivot point of the push-out unit pushes the push-out unit with its free lower end constantly against the catch on the lever plate of the pivot ladder unit during the outward movement.

In a further particular advantageous embodiment the speed of the pivot unit is reduced with a tension spring, which connects the push-out unit with the support unit. Via the catch on the lever plate, the force is transmitted to the pivot unit and as a result, the speed of the pivot unit is limited.

In a further advantageous embodiment, the push-out unit is moved by the pivot unit into the folded out position via a lever/guide mechanism. Hereby, the push-out unit is guided in a guide groove arranged on the lever plate by a bolt provided on a lower free end of the lever plate. The lever plate is connected with the pivot unit. The bolt of the push-out unit is guided in the guide groove. As a result, when unfolding the pivot unit from the resting position into the operating position, the push-out unit is pushed outwardly away from the support unit.

In a further embodiment of the self-rescue system according to the invention, a compression spring pushes the push-out unit into the operating position in which it is spaced apart from the support unit. This compression spring also connects the push-out ladder unit with the support unit.

A further particularly advantageous embodiment is a torsion spring arranged in the rotation center of the push-out unit, which pushes the push-out unit into the operating position.

In a further particularly advantageous embodiment of the self-rescue system according to the invention two hydraulic cylinders, which are interconnected via hydraulic lines and have pressure accumulators as compensation unit, are assigned to the speed throttling. It is provided that the first hydraulic cylinder absorbs the kinetic energy of the pivot unit during unfolding and transmits the kinetic energy to the second hydraulic cylinder and that the push-out unit can be moved apart from the support unit with the inputted kinetic energy.

In a further advantageous embodiment of the self-rescue system according to the invention the push-out unit and the pivot unit can be driven via pressure accumulators that are connected with the hydraulic cylinders and which can be triggered by means of directional valves by manual actuation.

According to an advantageous embodiment, the hydraulic cylinders, and with this the drive for the push-out unit and the pivot unit, are connected via a hydraulic oil supply which can be triggered by means of directional valves by manual actuation and foot actuation and further hydraulic components (valves). Via hydraulic control components the hydraulic supply can move the push-out unit and the pivot unit back into the resting (starting) position again.

In a further particularly advantageous embodiment, the push-out unit is driven by the pivot ladder unit via a pinion or pinions/toothed rack combination. The toothed rack slides on a guide rail of the support unit. On the outwardly oriented end of the toothed rack, a guide is located which guides the push-out unit in the lever plate by means of a cam. The pinion gear drive is fixedly connected with the pivot ladder unit. During downward pivoting of the pivot ladder unit, the pinion may drive the toothed rack directly or via a further gear (intermediate gear), which is rotatably supported on the support unit. The push-out unit is thus driven by the pivot unit via a pinion/toothed rack combination, wherein the toothed rack is arranged slidingly on a guide and the push-out unit is guided by means of a cam. The drive gear is fixedly connected with the pivot unit, coaxial to the bearing device and during downward pivoting of the pivot unit drives the toothed rack directly or via the intermediate gearwheel.

According to an advantageous embodiment, the push-out unit of the self-rescue system can be provided with an unfoldable back protection. The back protection is pivotably supported on the push-out unit with a bearing device and folds out when the push-out unit is pivoted, in that the back protection is kicked or is pulled along by a catch situated on the pivot unit. The weight of the back protection causes it to fall against stops provided on the push-out unit. The back protection is formed by arches, which are interconnected by rods, and of a bearing device, in the starting position the pivotable back protection is pushed against the push-out unit by the pivot ladder unit.

The foldout movement of the pivot unit can also be limited or throttled with a valve arranged in the hydraulic circuit of the hydraulic cylinders. With this the pivot unit can generally be held at any angle relative to the push-out unit and the support unit. This can be advantageous in particular when the large machine is tilted relative to the ground.

In a particularly advantageous embodiment of the self-rescue system according to the invention it is provided that the pivot unit can be fixed in the resting position at the upper free end of the support unit with a release mechanism. The release mechanism is advantageously configured as foot-operable mechanism, which can be triggered after prior pulling of a safety bolt. The release mechanism can be configured spring loaded so that the pivot unit is automatically pivoted away or pushed away from the support unit by the impulse induced by the preloaded spring.

BRIEF DESCRIPTION OF THE DRAWING

In the following the invention is explained in more detail by way of an exemplary embodiment with reference to the included drawings. It is shown in.

DETAILED DESCRIPTION OF PREFERRED EMBODIMENTS

Figure 1:
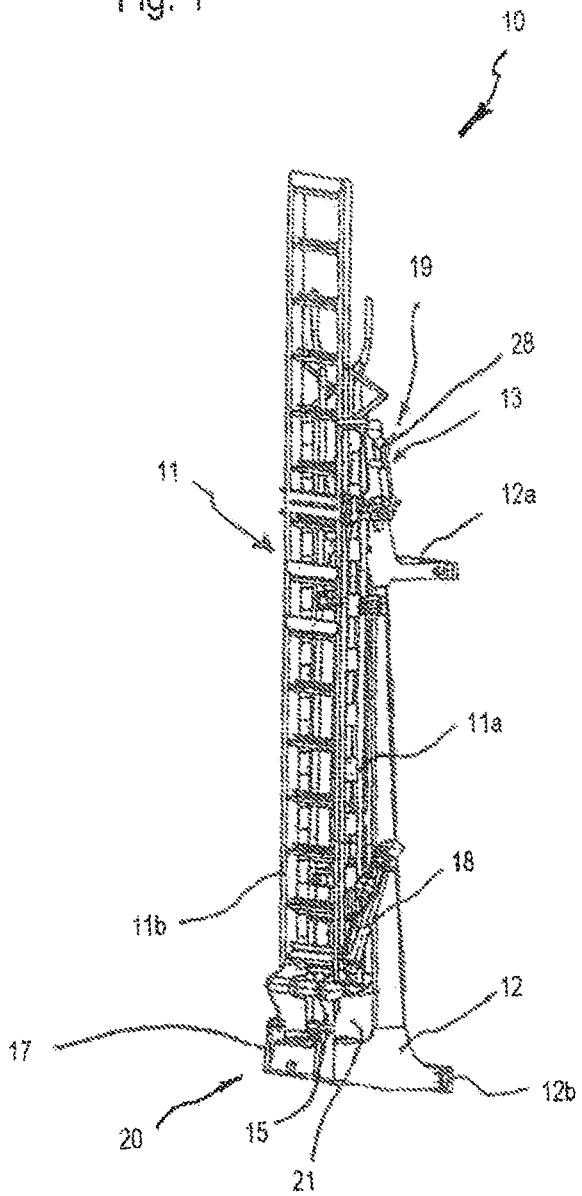
FIG. 1 an isometric representation of a first embodiment of the self-rescue system according to the invention in the resting position in which the push-out unit and the pivot unit rest against each other and are oriented parallel to the carrier unit.

In all Figures the same components are always provided with the same reference numerals. As shown in FIG. 1 the self-rescue system 10 is substantially formed by a two-part descent means 11, which in the resting position—i.e., in the folded state—forms a compact unit. The descent means 11 is divided into a push-out unit 11*a* and a pivot unit 11*b*, which in the resting position are configured to rest against each another in parallel relationship with each other. The two-part descent means 11 is held by a support unit 12 connected with the descent means. The support unit 12 is connected on a side surface C to a large machine (not shown) for example by screwing.

The support unit 12 in turn is releasably connected with a not shown large machine with connection means 12*a*, 12*b*. The support unit 12 and the descent means 11 are configured in the resting position so as to only protrude over the footprint of the large machine (for example an industrial hydraulic back hoe) to an extent that enables avoiding a collision with another vehicle (for example a large excavation kipper). The unit of descent means 11 and support unit 12 is further configured so as to not hinder the pivot radius of the superstructure of a large machine.

The push-out unit 11*a* is rotatably connected with the support unit 12 on the upper free end 19 of the support unit via a first bearing device 13.

The pivot unit 11*b* is rotatably connected with the support unit 12 at the lower free end 20 of the support unit via a second bearing device 15. A lever plate 21 is provided which is fixedly (rigidly) connected with the pivot unit 11*b*. The lever plate 21 includes a catch 41 and the second bearing device 15. The lever plate 21 in turn is rotatably connected with the support unit 12 at its lower free end 20 via the second bearing device 15.

Generally the push-out unit (11*a*) and the pivot unit (lib) can be formed as ladder elements with rungs or as stair elements with stepping and/or sitting steps or a combination of ladder element and stair element. For example the push-out unit (11*a*) can be configured as a ladder element and the pivot unit (11*b*) as a stair element or vice versa.

Figures 2, 3:
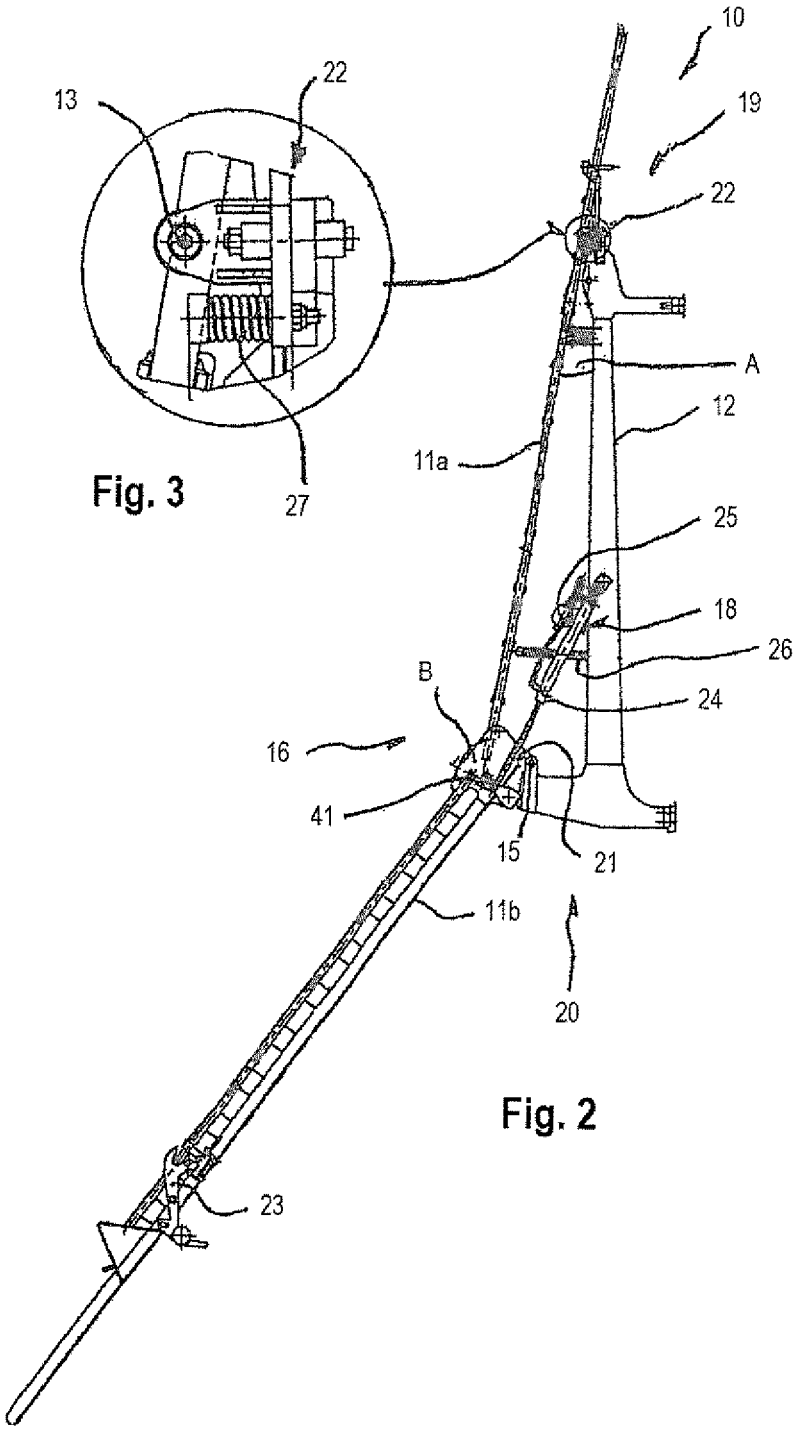
FIG. 2 the isometric representation of the self-rescue system according to the invention in the operating position, wherein in the unfolded state the two-part ladder system has a walk-friendly tilting angle relative to the support unit.
FIG. 3 an enlarged representation in side view of the release mechanism as shown in FIG. 2.
Figure 4A:
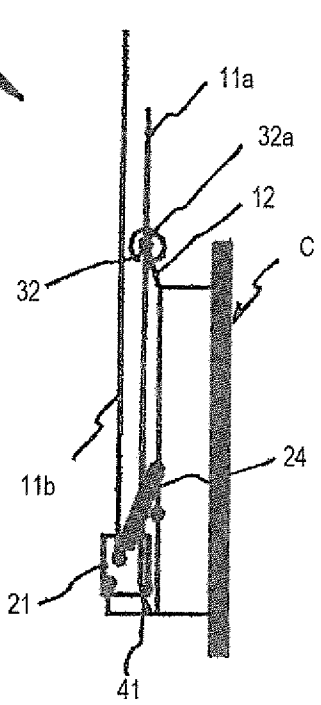
FIG. 4*a* the self-rescue system according to the invention according to FIG. 4 in the resting position.
Figure 4:
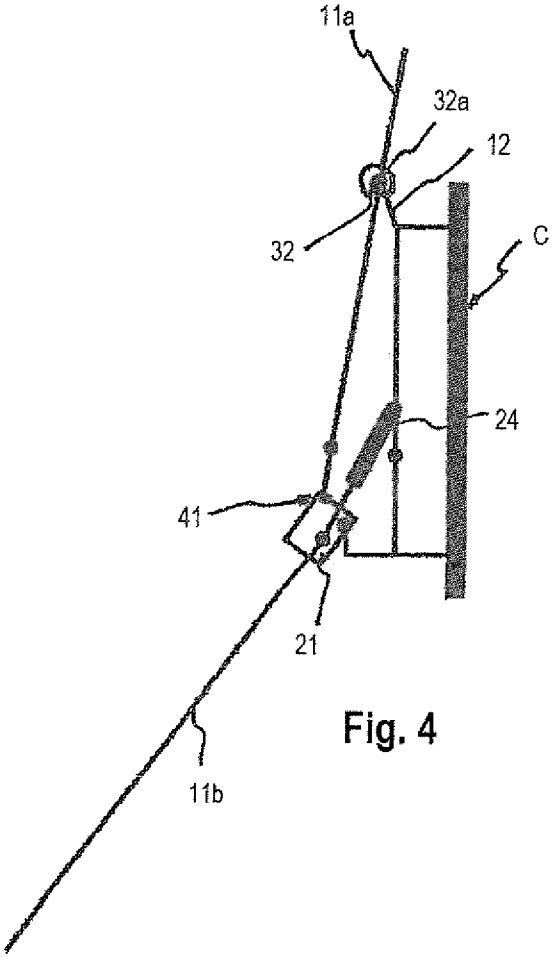
FIG. 4 the schematic representation of the self-rescue system according to the invention in the operating position as in FIG. 12, wherein a torsion spring is assigned to the push-out unit at the point at which the push-out unit is pivotally connected.

FIG. 2 shows the self-rescue system 10 according to the invention in the operating position. Hereby the push-out unit 11*a* and the pivot unit 11*b* of the descent means 11 are spaced apart from the support unit 12 and form over the entire length of the constructive height a slant 16. The slant 16 is hereby angled relative to the support unit 12 so that the bodily exertion during descent or during walking is within the range of the statistical average fitness of a user. Correspondingly, the angle is selected as large as possible in order to from a walk friendly slant in the pivoted state.

The pivot ladder system can be installed in a large hydraulic backhoe. The assembly made of the descent means 11 and the support unit 12 is screwed to various locations of the upper structure of the vehicle. As described above the assembly serves for being able to quickly and safely escape from the machine in the event of an emergency (fire on the large machine or other hazardous situations). Hereby the undercarriage (for example a crawler chassis) can be oriented rotated diagonally relative to the superstructure (both not shown).

The self-rescue system 10 is triggered via a release mechanism 22, which is shown again enlarged in FIG. 3. Hereby the pivot unit 11*b* is released with the holding claw 23 assigned to the pivot unit from the release mechanism 22, which is assigned to the upper free end 19 of the support unit 12. In this embodiment it is provided that the release mechanism 22 is configured to be operated by foot, but also a hand operated release mechanism is possible.

In order to prevent an unintended release, a safety bolt 28 is provided which fixes the holding claw 23 relative to the support unit 12. After pulling the safety bolt 28 an impulse introduced into the holding claw 23 releases the holding claw from the release mechanism 22 and the pivot unit 11*b* then automatically pivots downwards due to gravity acting on the pivot unit into the operating position.

The pivot unit 11*b* is hereby on one side fixedly connected with the lever plate 21 and on the other side connected on the lower free end 20 of the support unit 12 with the second bearing device 15 assigned to the lever plate for rotation. The catch 41 is arranged on the lever plate 21. Catch 41 and second bearing device 15 are spaced apart from each other in the lever plate 21, as a result of which the lever plate functions as lever.

Hereby the downwardly pivoting pivot unit 11*b* drives the push-out unit 11*a* by means of the lever mechanism and moves the push-out unit away from support unit 12 into a position that is slanted relative to the support unit 12 with a first angle A. The pivot process is finished when the pivot unit 11*b* has reached a mechanical stop 17 arranged on the support unit 12. Hereby the pivot unit 11*b* forms a flattest possible angle B together with the push-out unit 115. It is hereby provided that the pivot unit 11*b* in the pivoted state does not rest on the ground (not shown) but is rather suspended freely above the ground. Instead of the mechanical stop 17 or in addition to the mechanical stop 17 also a hydraulic holding device can be provided which holds the pivot unit in a predetermined manner above the ground.

In this embodiment, it is provided that the pivot speed is controlled for safety reasons via a speed throttling device 18.

In this embodiment, the speed throttling device 18 is a hydraulic cylinder unit 24 with a pressure accumulator 25 connected to the hydraulic cylinder unit 24 and a throttle (not shown).

Because the lever mechanism guides the push-out unit 11*a* in only one direction the push-out unit is free in the opposite direction. When descending, the user supports his/herself and pulls the push-out unit 11*a* toward himself and away from the support unit 12. In order for the user to not pull the push-out unit 11*a* toward himself/herself and thus inadvertently push it to an unwanted degree away from the support unit 12, a tension spring 26 is provided which connects the push-out unit 11*a* with the support unit 12 and thus prevents an uncontrolled moving away by a user from the support unit 12.

The downward pivoting pivot unit 11*b* exerts an amount of energy, which is sufficient to push out the push-out unit 11*a* and also to overcome the force of the tension spring 26 and the speed throttling 18. Hereby the weights of the individual components and the tensile and compression stresses of the above mentioned throttling means are adjusted to each other.

Push-out unit 11*a*. In this embodiment a torsion spring 32 is assigned on the upper free end 19 to the support unit 12 on a pivot point 32*a*. The torsion spring 32*a* is thus connected with the push-out unit 11*a* so that the push-out unit is able to rotate about the pivot point 32. During pivoting out or moving apart the push-out unit 11*a* is force fittingly pushed with its lower free end 33 against a catch 41, which is arranged on the lever plate 21. This prevents the push-out unit 21 from unintentionally lifting or jumping off. The hydraulic cylinder unit 24 is on one side connected with the support unit 12 and on the other side with the pivot unit 11*b* via the lever plate 21.

Figure 5A:
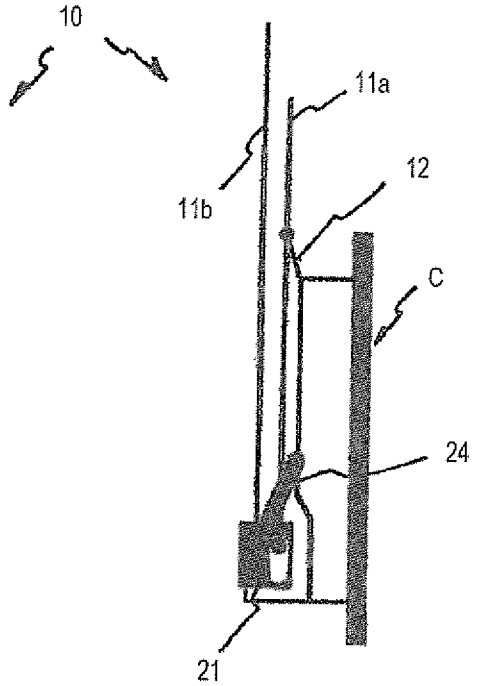
FIG. 5*a* the self-rescue system according to FIG. 5 in the resting position.
Figure 5:
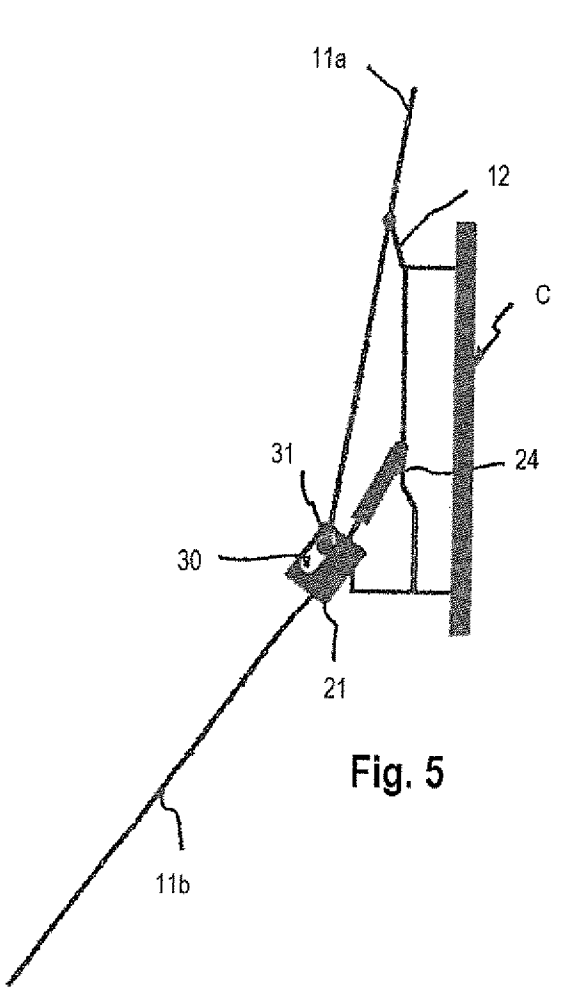
FIG. 5 the schematic representation of a further embodiment of the self-rescue system according to the invention, wherein the push-out unit is connected with the pivot unit via a groove and bolt system via a guide groove.

FIGS. 5 and 5*a* show a further embodiment of the bearing or guided connection between the push-out unit 11*a* and the pivot unit 11*b* in the operating position or resting position. Hereby a guide groove 30 is provided in the lever plate 21. In the guide groove 30 the push-out unit 11*a* is guided on the bolt 31 that is assigned to its lower free end 33. During pivoting of the pivot unit 11*b* the speed of the foldout movement is controlled via the hydraulic cylinder unit 24. The bolt 31 is guided during the unfolding out or folding in the guide groove 30.

Figure 6A:
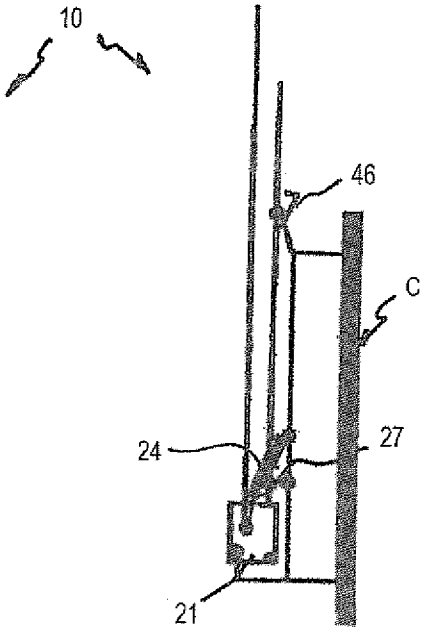
FIG. 6*a* the self-rescue system according to FIG. 6 in the resting position.
Figure 6:
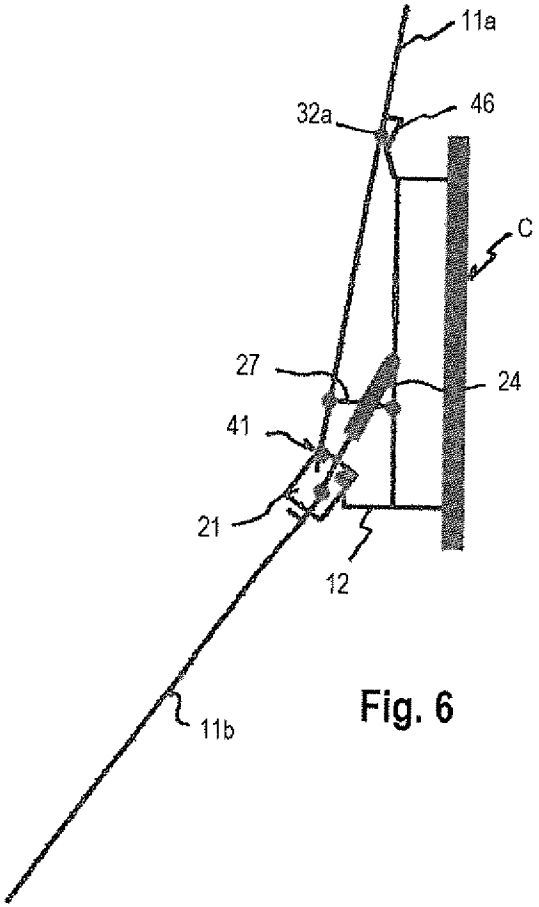
FIG. 6 the schematic representation of the self-rescue system of FIG. 1, wherein a mechanical stop is provided in the region of the upper free end of the support unit.

FIG. 6 and FIG. 6*a* differ form the embodiment according to FIG. 1 in that a mechanical stop 46 is arranged in the support unit 12 above the pivot point 32*a* and instead of a tension spring a compression spring 27 connects the push-out unit 11*a* with the support unit 12. The mechanical stop 46 limits the deflection of the compression spring 27 and holds the push-out unit 11*a* in the operating position under spring tension. In order to prevent sagging of the push-out unit ha when a user walks on it, the push-out unit is connected with the catch 41 on the lower free end 33.

Figure 7A:
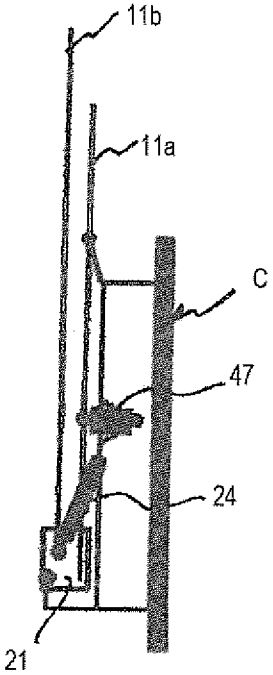
FIG. 7*a* the self-rescue system according to FIG. 7 in the resting position.
Figure 7:
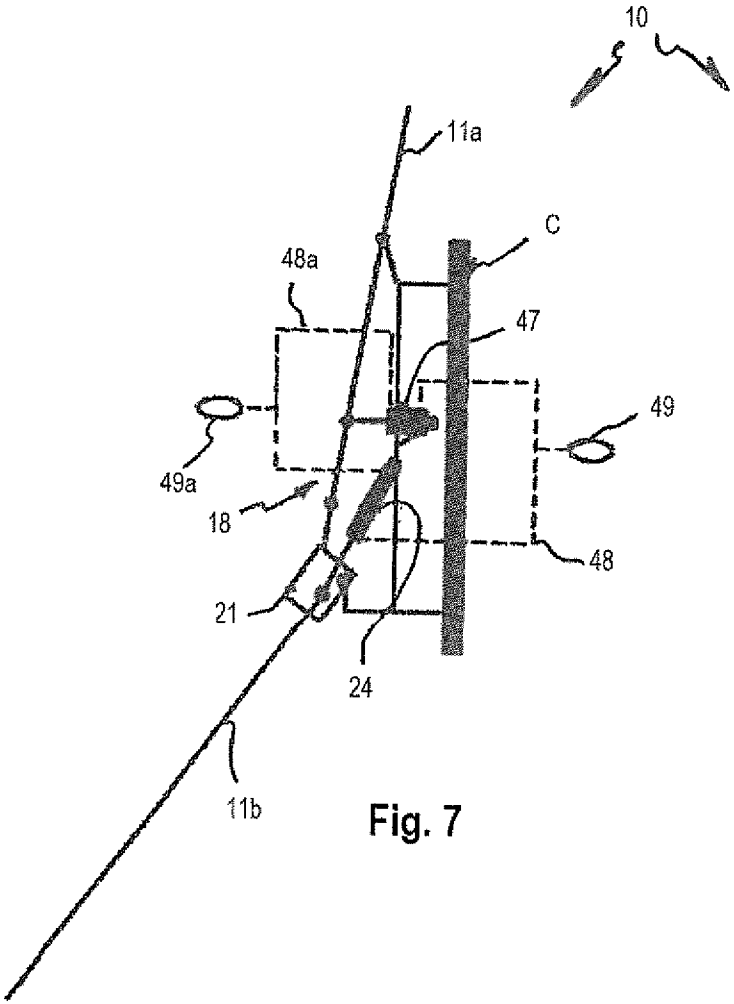
FIG. 7 the schematic representation of a further embodiment of the self-rescue system according to the invention with a second hydraulic cylinder unit and assigned pressure accumulators in order to move the push-out unit and the pivot unit from the resting position into the operating position and vice versa in a controlled manner.

FIG. 7 and FIG. 7*a* show a further embodiment of the emergency descending system 10 on one hand in the operating position and on the other hand in the resting position. Hereby two hydraulic cylinder units 24, 47 that are interconnected via a hydraulic circuit 48, 48*a* (shown in dashed lines) with pressure accumulator 49, 49*a* as compensation means are assigned to the speed throttling 18, wherein the first hydraulic cylinder unit 24 absorbs the kinetic energy of the pivot unit 11*b* during the pivoting out and transmits the kinetic energy to the second hydraulic cylinder unit 47 via the hydraulic circuit 48, 48*a* and with the introduced kinetic energy moves the push-out unit 11*a* apart from the support unit 12.

Figure 8A:
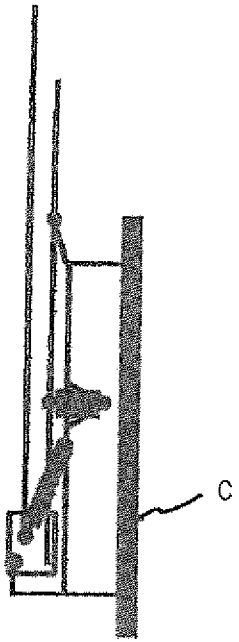
FIG. 8*a* the self-rescue system according to FIG. 8 in the resting position.
Figure 8:
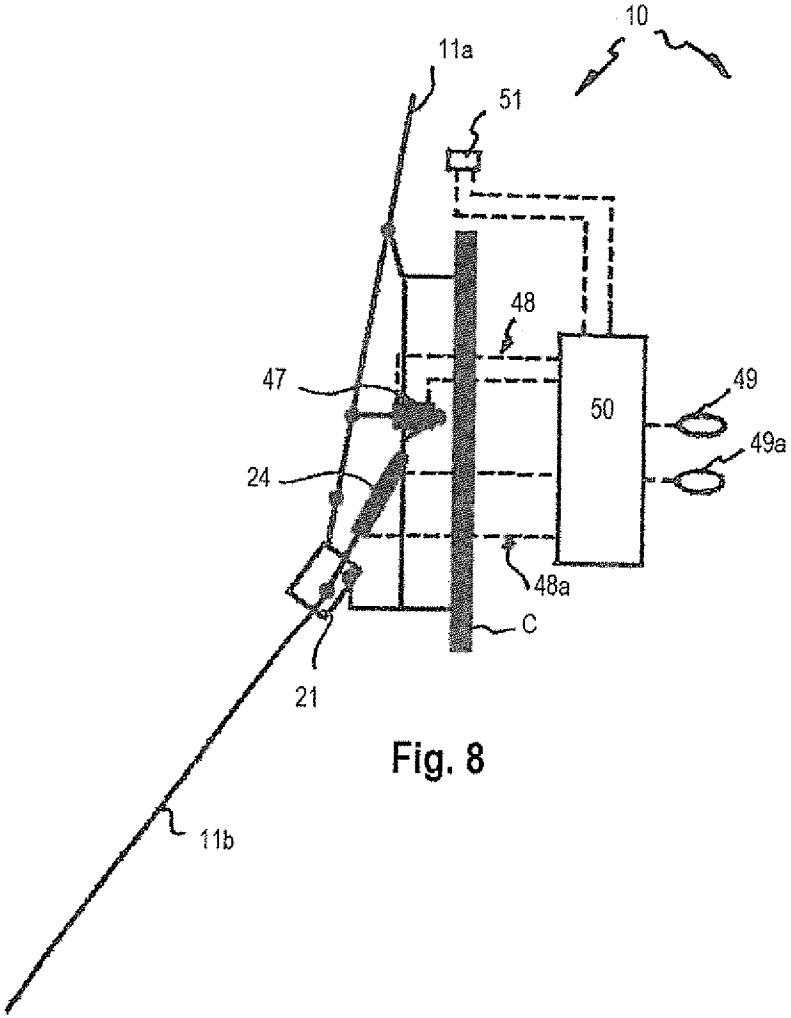
FIG. 8 the schematic representation of a further embodiment of the self-rescue system according to the invention with two hydraulic cylinders, wherein the hydraulic cylinders are connected with each other via a hydraulic control with preloaded pressure accumulators and the self-rescue system can be moved from the resting position in to the shown operating position via a hydraulic directional valve.

FIG. 8 and FIG. 8*a* show a further embodiment of the emergence descent system 10 on one hand in the operating position and on the other hand in the resting position. Hereby the push-out unit 11*a* and the pivot unit 11*b* are driven via the preloaded pressure accumulators 49, 49*a* that are connected with the hydraulic cylinder units 24, 47 by the hydraulic circuit 48 48*a* via at least one hydraulic directional valve 51. The hydraulic directional valve 51 can be triggered by hand or foot and thereby the emergency descent system 10 can be brought from the resting position into the operating position. Hereby the hydraulic supply is configured so that via a hydraulic control component 50, which is connected with the pressure accumulators 49, 49*a*, the push-out unit 11*a* and the pivot unit 11*b* can also be displaced/moved back into the resting position again.

Figure 9A:
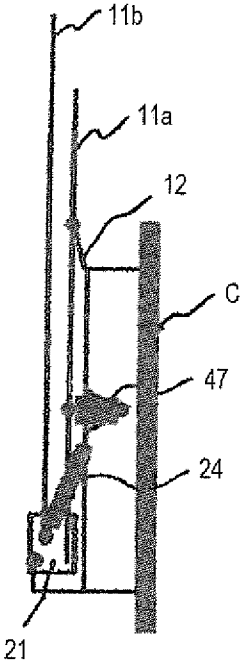
FIG. 9*a* the self-rescue system according to FIG. 9 in the resting position.
Figure 9:
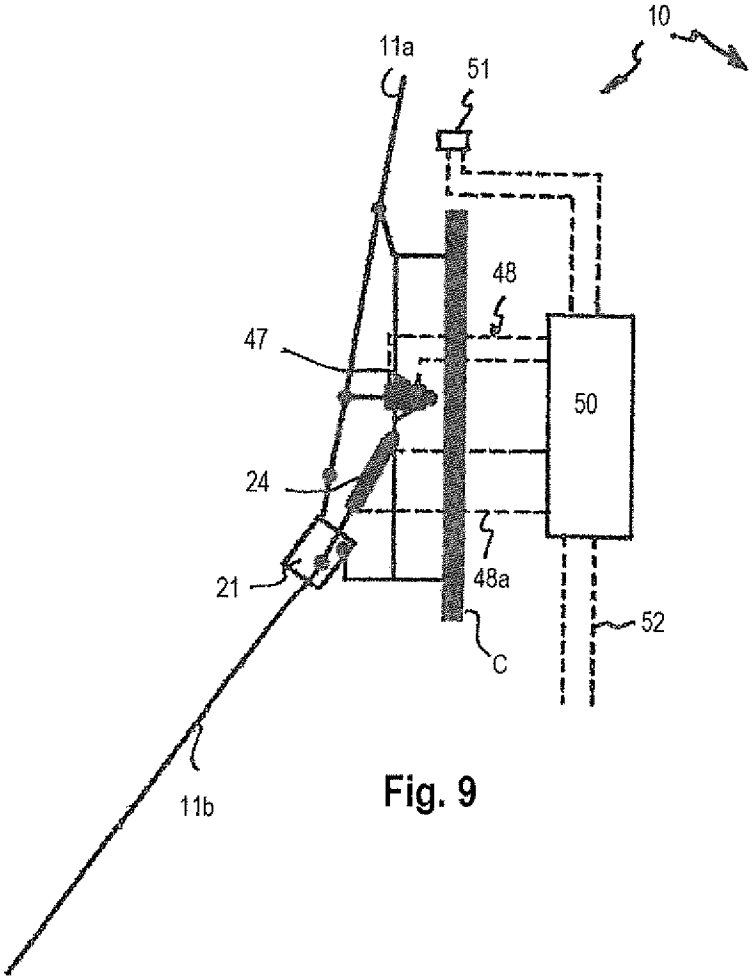
FIG. 9 the schematic representation of a further embodiment of the self-rescue system according to the invention with two hydraulic cylinders according to FIG. 8, wherein the hydraulic power supply is supplied to the hydraulic control by an external aggregate (large machine)

FIG. 9 and FIG. 9*a* show a further embodiment of the emergency descent system 10 according to the invention, on one hand in the operating position and on the other hand in the resting position, wherein the supply of the hydraulic cylinder units 24, 47 and with the drive of the push-out unit 11*a* and the pivot unit 11*b* occurs via an external hydraulic supply 52, which can be triggered by hand or by foot by means of at least one hydraulic directional valve 51. The hydraulic cylinder units 24, 47 are controlled via the hydraulic circuit 48, 48*a* connected with the control component 50.

Figure 10A:
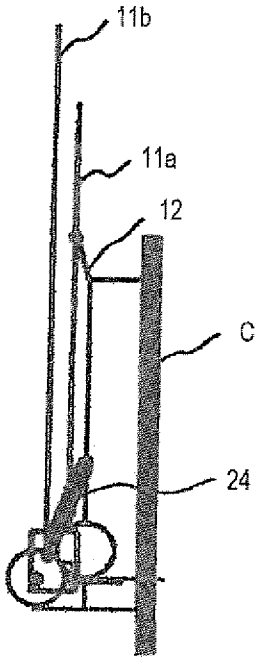
FIG. 10*a* the self-rescue system according to FIG. 10 in the resting position.
Figure 10:
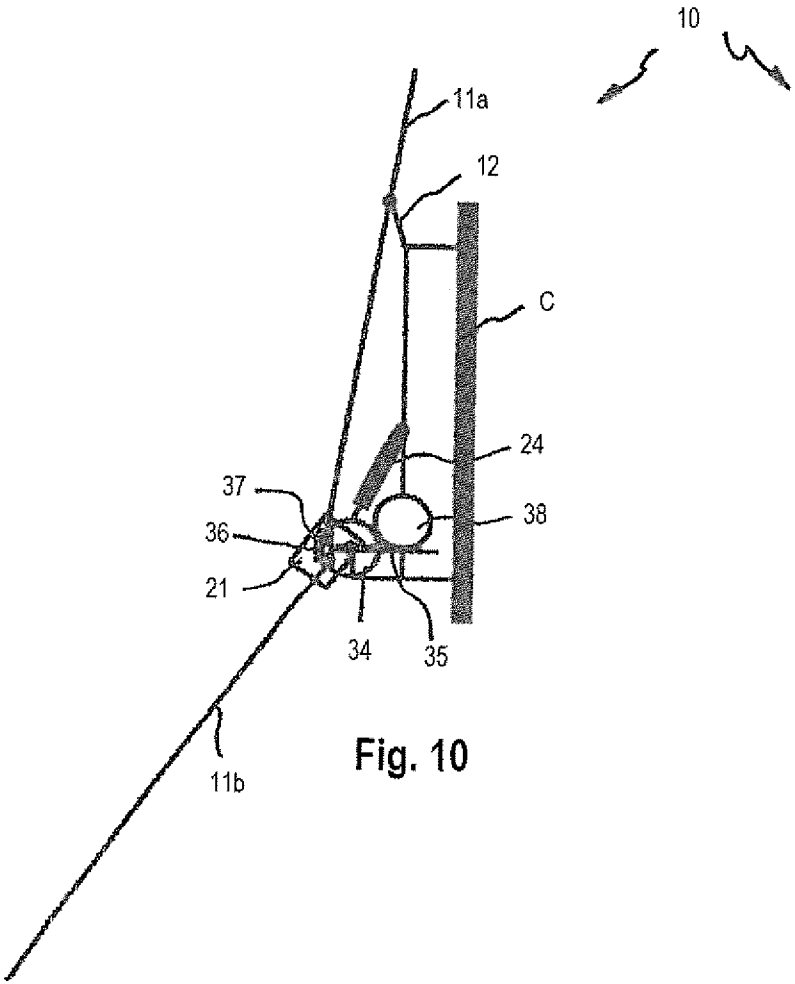
FIG. 10 the schematic representation of a further embodiment of the self-rescue system according to the invention with only one hydraulic cylinder for limiting the pivot speed, wherein the pivot unit is configured for pivoting about the axis of a gearwheel fixedly connected with the pivot unit and the push-out unit is operatively connected with the pivot unit via an intermediate rotatably supported in the support unit and a gear rod via the fixed gearwheel.

FIG. 10 and FIG. 10*a* show a further embodiment of the emergency descent system 10 on one hand in the operating position and on the other hand in the resting position, wherein the drive of the push-out unit 11*a* is accomplished by the pivot unit 11*b* via a drive gearwheel 34 and an intermediate gearwheel/gear rod combination, wherein the toothed rack 35 is arranged slidingly on a guide mechanism 36 (guide) and guides the push-out unit 11*a* by means of a cam 37. The drive gearwheel 34 is in this embodiment fixedly connected with the pivot unit 11*b* (coaxial to the second coupling device) and drives during downward pivoting of the pivot unit 11*b* the toothed rack 35 via the intermediate gearwheel 38, which toothed rack drives the outward movement of the push-out unit 11*a* via the cam 37. The hydraulic cylinder unit 24 is connected with the lever plate 21 and can have a pressure accumulator (volume compensation accumulator) and a throttle in order to be able to limit the pivot speed of the pivot unit 11*b*.

Figure 11A:
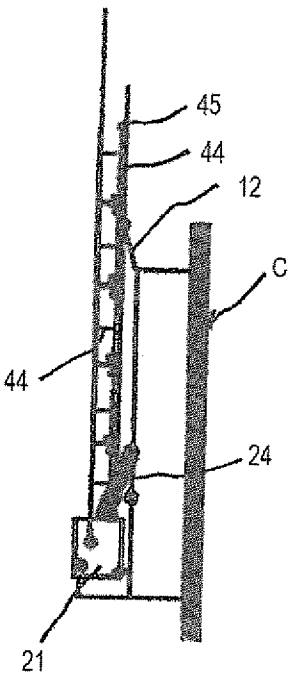
FIG. 11*a* the self-rescue system according to FIG. 11 in the resting position.
Figure 11:
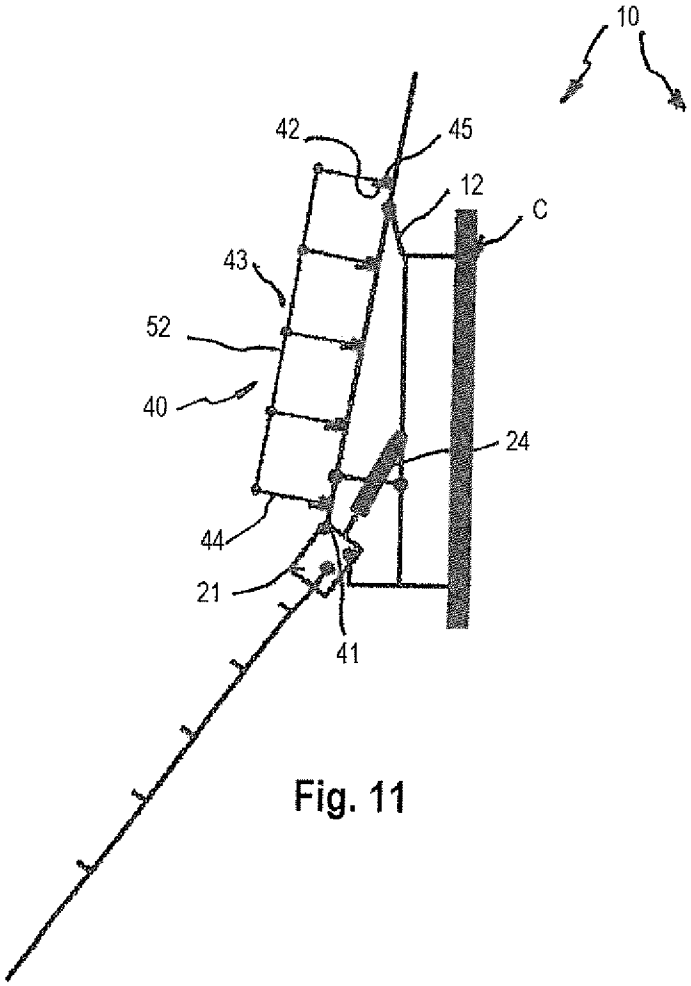
FIG. 11 the schematic representation of a further embodiment of the self-rescue system according to the invention according to one or more of the FIGS. 1 to 10 above wherein a foldable and unfoldable back protection is assigned to the push-out unit, which back protection is pivotally connected on the push-out unit via a bearing device.

FIG. 11 and FIG. 11*a* show a further embodiment of the emergency descent system 10, on one hand in the operating position and on the other hand in the resting position with an additional means arranged thereon. The additional means is not necessarily limited to this embodiment but can rather be brought in operative connection with all embodiments described in the description. The additional means is an unfoldable back protection 40 which together with the push-out unit 11*a* can be unfolded or folded. During the unfolding of the push-out unit 11*a* the back protection 40 is pulled along by a catch 53 of the pivot unit 11*b* and unfolded. During the pivoting out of the push-out unit 11*a* the back protection 40 is moved as a result of the gravity acting on it against stops 42 provided on the push-out unit 11*a*. In the resting position the unfoldable back protection 40 is pushed against the push-out unit 11*a* by the pivot unit (11*b*). The back protection 40 is formed by arches 43, which are made of correspondingly arched rods or bands 44 which are aligned with each other in longitudinal direction of the push-out unit 11*b*. The arches 43 of the back protection 40 are supported on the push-out unit for rotation via a third bearing device 45. The individual rods or bands 44 of the arches 43 are connected with each other via an intermediate guide rod 52 which is arranged on the apex of the curvature of the arches. The arches 43 together with the push-out unit 11*a* thus form a walkable tunnel-like protective tube.

What is claimed is:

1. An emergency descent system, comprising:

a support unit having a stop;

a ladder rotatably connected to the support unit and comprising a push-out unit and a pivot unit pivotally connected to the push-out unit;

a separate lever plate fixedly connected to said pivot unit and pivotally and directly connected to said push-out unit, said lever plate being rotatably connected to said support unit via a bearing device, said lever plate configured to allow the ladder to unfold from a resting position, in which the push-out unit and the pivot unit are disposed parallel to the support unit, to an operating position, in which the push-out unit and the pivot unit both pivot outwardly away from the support unit;

wherein during pivoting into the operating position, the pivot unit generates kinetic energy and with the kinetic energy drives the push-out unit to undergo an outward movement away from the support unit, and wherein in the operating position, the push-out unit forms an acute angle with the support unit and the pivot unit is held on the stop of the support unit at an obtuse angle relative to the push-out unit.

2. The emergency descent system of claim 1, further comprising a tension spring for braking the outward movement of the push-out unit and a speed throttling device for braking the pivot unit.

3. The emergency descent system of claim 2, wherein the support unit, the push-out unit, the pivot unit, and the speed throttling device are connected with each other to form a single constructive unit.

4. The emergency descent system of claim 1, wherein in an installed position of the support unit, the support unit has an upper free end and a lower free end, wherein the push-out unit is connected with the support unit at the upper free end via a further bearing device and is connected to the support unit by the lever plate which is connected with the lower free end of the support unit via the bearing device.

5. The emergency descent system of claim 4, wherein the push-out unit is connected with the support unit via a tension spring.

6. The emergency descent system of claim 5, wherein a speed of the pivoting of the pivot unit into the operating position is reducible via the tension spring, wherein a force occurring during the pivoting of the pivot unit is transmitted to the pivot unit via the lever plate thereby limiting the speed of the pivoting of the pivot unit.

7. The emergency descent system of claim 4, further comprising a torsion spring arranged in a rotation point of the push-out unit, said torsion spring constantly pushing a free end of the push-out unit against the lever plate during the outward movement.

8. The emergency descent system of claim 7, wherein the torsion spring forms the further bearing device and the push-out unit is rotatably arranged in the rotation point of the bearing device so as to be pushable via the torsion spring from the resting position into the operating position.

9. The emergency descent system of claim 4, further comprising a compression spring connecting the push-out unit with the support unit, said compression spring is configured to prevent an uncontrolled moving away of the ladder from said support unit.

10. The emergency descent system of claim 9, further comprising another compression spring connected with the support unit in a region of the upper free end of the support unit and being supported against the pivot unit, said other compression spring being configured for moving the pivot unit apart from the support unit, said other compression spring being preloaded in the resting position and relaxed in the operating position.

11. The emergency descent system of claim 2, wherein the speed throttling device is constructed as a hydraulic cylinder brake system comprising a compensation unit which is configured as a pressure accumulator.

12. The emergency descent system of claim 11, wherein the speed throttling device comprises two hydraulic cylinder units each having one said compensation unit, said two hydraulic cylinder units being interconnected via a hydraulic circuit, wherein one of the hydraulic cylinder units takes up the kinetic energy of the pivot unit during the pivoting of the pivot unit and transmits the kinetic energy to the other one of the hydraulic cylinder units via the hydraulic circuit and with the introduced kinetic energy moves the push-out unit away from the support unit.

13. The emergency descent system of claim 12, wherein the push-out unit and the pivot unit are driven via the pressure accumulators, which are connected with the hydraulic cylinder units via the hydraulic circuit, said pressure accumulators activatable by means of hydraulic directional valves by hand or by foot actuation, to thereby move the emergency descent system from the resting potion into the operating position, wherein a hydraulic supply of the hydraulic cylinder units is configured so that the push-out unit and the pivot unit can be moved from the operating position into the resting position via a control component connected with the pressure accumulators.

14. The emergency descent system of claim 13, wherein the supply of the hydraulic cylinder units is configured to drive the ladder when an external hydraulic oil supply is triggered by means of directional hydraulic valves capable of being moved by manual actuation.

15. The emergency descent system of claim 14, further comprising a throttle arranged in the hydraulic circuit of the hydraulic cylinder units and configured to limit the pivoting of the pivot unit.

16. The emergency descent system of claim 1, further comprising a release mechanism, configured for fixing the pivot unit in the resting position at an upper free end of the support unit.

17. The emergency descent system of claim 1, further comprising an unfoldable back protection which is rotatably supported on the push-out unit with another further bearing device.

* * * * *